US009607760B2

(12) United States Patent
Fukuzaki et al.

(10) Patent No.: US 9,607,760 B2
(45) Date of Patent: Mar. 28, 2017

(54) APPARATUS FOR RAPIDLY SOLIDIFYING LIQUID IN MAGNETIC FIELD AND ANISOTROPIC RARE EARTH PERMANENT MAGNET

(71) Applicant: SAMSUNG ELECTRONICS CO., LTD., Suwon-si, Gyeonggi-do (KR)

(72) Inventors: Tomokazu Fukuzaki, Yokohama (JP); Kazutomo Abe, Yokohama (JP)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 550 days.

(21) Appl. No.: 14/100,203

(22) Filed: Dec. 9, 2013

(65) Prior Publication Data

US 2014/0159842 A1 Jun. 12, 2014

(30) Foreign Application Priority Data

Dec. 7, 2012 (JP) ..... 2012-268853
Aug. 26, 2013 (KR) ..... 10-2013-0101139

(51) Int. Cl.
*H01F 41/02* (2006.01)
*H01F 1/057* (2006.01)

(52) U.S. Cl.
CPC ..... *H01F 41/0273* (2013.01); *H01F 1/0579* (2013.01)

(58) Field of Classification Search
CPC ..... H01F 1/442; H01F 41/0273; H01F 1/0579
See application file for complete search history.

(56) References Cited

U.S. PATENT DOCUMENTS 4,785,671 A * 11/1988 Wakamiya ..... G01L 3/102 73/728
6,144,132 A * 11/2000 Nashiki ..... H02K 1/2713 310/152
6,261,385 B1 7/2001 Nomura et al.
6,328,817 B1 12/2001 Murakami
6,527,874 B2 3/2003 Li
6,773,517 B2 8/2004 Sakaki et al.
7,211,157 B2 5/2007 Sakaki et al.
7,691,323 B2 4/2010 Sakaki et al.
2002/0017338 A1 2/2002 Li
2002/0054825 A1 5/2002 Sukaki et al.
2006/0005898 A1 1/2006 Liu et al.
2006/0185766 A1 8/2006 Sakaki et al.
2007/0051431 A1 3/2007 Sakaki et al.
2008/0277028 A1 11/2008 Sakaki et al.
2010/0068512 A1 3/2010 Imaoka et al.

FOREIGN PATENT DOCUMENTS

JP 63-042329 A 2/1988
JP 04-259350 A 9/1992
(Continued)

OTHER PUBLICATIONS

English Abstract and English Machine Translation of Asai et al. (JP 2003-342100).*

*Primary Examiner* — Jessee Roe
(74) *Attorney, Agent, or Firm* — Contor Colburn LLP

(57) ABSTRACT

An apparatus for solidifying liquid in a magnetic field includes a magnetic circuit applying the magnetic field greater than or equal to about 1 tesla to a solidified part.

7 Claims, 2 Drawing Sheets

(56) References Cited

FOREIGN PATENT DOCUMENTS

| | | | |
|---|---|---|---|
| JP | 06-325916 | A | 11/1994 |
| JP | 09-097731 | A | 4/1997 |
| JP | 10-144509 | A | 5/1998 |
| JP | 11-097222 | A | 4/1999 |
| JP | 2001-307913 | A | 11/2001 |
| JP | 2002-083705 | A | 3/2002 |
| JP | 2002-088451 | A | 3/2002 |
| JP | 2003-342100 | A | 12/2003 |
| JP | 2005-064096 | A | 3/2005 |
| JP | 2005-272924 | A | 10/2005 |
| JP | 2008-505500 | A | 2/2008 |
| JP | 2011-143455 | A | 7/2011 |
| KR | 1020090130135 | A | 12/2009 |

* cited by examiner

APPARATUS FOR RAPIDLY SOLIDIFYING LIQUID IN MAGNETIC FIELD AND ANISOTROPIC RARE EARTH PERMANENT MAGNET

CROSS-REFERENCE TO RELATED APPLICATION

This application claims priority to Japanese Patent Application No. 2012-268853 filed on Dec. 7, 2012 and Korean Patent Application No. 10-2013-0101139 filed on Aug. 26, 2013, and all the benefits accruing therefrom under 35 U.S.C. §119, the entire contents of which are incorporated herein by reference.

BACKGROUND

1. Field

An embodiment of the present invention relates to an apparatus for rapidly solidifying liquid in a magnetic field. The apparatus may include an anisotropic exchange spring magnet mounted with a rapidly-solidified thin strip in which a magnetic easy axis of a hard magnetic phase is arranged in one direction by rapidly solidifying in the magnetic field, and may include an anisotropic rare earth permanent magnet having a high coercive force and a high remaining magnetic flux density. Another embodiment of the present invention relates to an anisotropic rare earth permanent magnet having a higher magnetic flux as a rotor magnet of a motor than that of the conventional samarium magnet to remarkably improve the motor output, and relates to an anisotropic permanent magnet obtained by pressing and sintering the rapidly-solidified thin strip of which the magnetic easy axis is arranged in a magnetic field, thereby having excellent magnetic characteristics compared to an isotropic magnet.

2. Description of the Related Art

An exchange spring magnet is a novel kind of permanent magnet in which a soft magnetic phase (e.g., α-Fe etc.) and a hard magnetic phase (e.g., Sm—Co etc.) are dispersed in a nano size in the same magnet. The exchange spring magnet simultaneously has high magnetic induction of a soft magnetic phase and high coercive force of a hard magnetic phase by the magnetic exchange bond acting between both phases. Commercialization of the exchange spring magnet is developing since the possibility of remarkably overcoming the magnetic characteristics of the conventional sintering magnet is theoretically suggested.

SUMMARY

An embodiment of present invention provides an apparatus for rapidly solidifying liquid in a magnetic field so that an anisotropic exchange spring magnet and an anisotropic rare earth permanent magnet having a high coercive force and a high remaining magnetic flux density may be fabricated, and an anisotropic rare earth permanent magnet having a higher magnetic flux as a rotor magnet of a motor than that of the conventional samarium magnet so that the motor output may be remarkably improved.

In an embodiment, an apparatus for rapidly solidifying liquid in a magnetic field may include a magnetic circuit applying a magnetic field greater than or equal to about 1 tesla (T) into a rapidly-solidified part and characterized in that a rapidly-solidified thin strip is fabricated in the magnetic field.

In an embodiment, the rapidly-solidified thin strip may be provided by a single roll casting method.

In an embodiment, an anisotropic rare earth permanent magnet may include a rapidly-solidified thin strip obtained by rapidly solidifying an exchange spring magnet. The exchange spring magnet may have an internal structure in which a hard magnetic phase and a soft magnetic phase finely dispersed in the magnetic field by using the apparatus for rapidly solidifying liquid in the magnetic field. The magnetic easy axis of the hard magnetic phase in the rapidly-solidified thin strip may be arranged in one direction.

In an embodiment, the hard magnetic phase may include at least one of $SmCo_5$, $Sm_2Co_{17}$ and $Nd_2Fe_{14}B$, and the soft magnetic phase may include at least one of α-Fe, FeCo and $Fe_3B$ in the exchange spring magnet.

In an embodiment, a bulk anisotropic rare earth permanent magnet may be obtained by temporarily molding the rapidly-solidified thin strip obtained by using the apparatus for rapidly solidifying liquid in the magnetic field by a magnetic field press, and sintering the same.

BRIEF DESCRIPTION OF THE DRAWING

The above and other embodiments of this disclosure will become more apparent by describing in further detail embodiments thereof with reference to the accompanying drawings, in which.

DETAILED DESCRIPTION

Figure 1A:
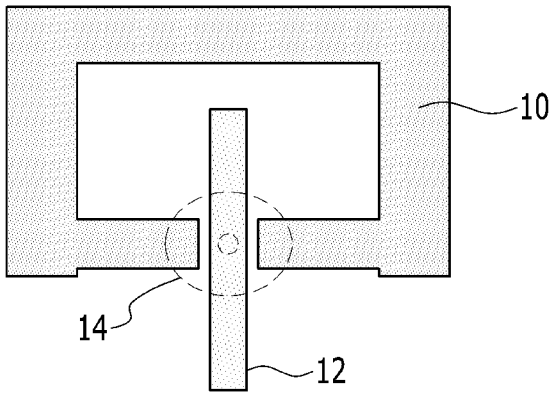
FIG. 1A is a schematic plan view showing an embodiment of an apparatus for rapidly solidifying liquid in a magnetic field according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the FIGURE. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As a method of manufacturing an exchange spring magnetic having an internal structure in which the hard magnetic phase and the soft magnetic phase are finely dispersed, a method of rapidly solidifying liquid is suggested. The method of rapidly solidifying liquid provides a composite nanostructure of soft magnetic and hard magnetic by rapidly solidifying a melted metal alloy, and a liquid metal is strongly blown to a rotating copper roll to provide a rapidly-solidified thin strip as in a representative example of a single roll casting method or a strip casting method. The nanostructure is relatively easily obtained by adjusting an alloy composition, but a magnetic easy axis of crystal (c axis direction of a general rare earth element magnet) may not be arranged as the liquid metal is rapidly solidified, so only an isotropic magnet having a random crystalline direction may be provided. Since a crystalline direction is random after rapidly solidifying, it may be applied for an isotropic permanent magnet.

As techniques relating to an anisotropic magnet for an exchange spring magnet, a method of fabricating an anisotropic magnet including coating a metal film on a surface of a rapidly-solidified and amorphous powder, and heating the same to provide an anisotropic magnet is disclosed in, for example, Japanese Patent Laid-open No. 2005-272924, the contents of which is incorporated herein by reference in its entirety. In addition, a method of manufacturing an anisotropic magnet including coating a soft magnetic phase such as α-Fe on a surface of a rare earth element magnet and hot-deforming the same is disclosed in Japanese Patent Publication No. 2008-505500, the contents of which are incorporated herein by reference in its entirety. In addition, a method of manufacturing an anisotropic magnet including pressing and deforming a rapidly-solidified ribbon is disclosed in Japanese Patent Laid-open 11-97222, the contents of which are incorporated herein by reference in its entirety.

However, since the magnetic characteristics or the like are insufficient in the methods disclosed in these publications, a method of fabricating an anisotropic magnet in which the crystalline direction is arranged and having a superior magnetic characteristic, especially to that of the isotropic magnet are used.

Hereinafter, embodiments of the present invention are described in detail.

The apparatus for rapidly solidifying liquid in a magnetic field according to the embodiment includes a magnetic circuit applying the magnetic field greater than or equal to about 1 tesla (T) into the rapidly-solidified part in the apparatus for rapidly solidifying liquid, and provides a rapidly-solidified thin strip in the magnetic field.

The magnitude of magnetic field (magnetic flux density) applied in the rapidly-solidified part may be about 1 to about 2 T, for example, or about 1 T to about 8 T. When applying the ranged magnetic field, since a melted metal is crystallized by arranging a crystalline direction in a magnetic field direction when the melted metal is rapidly solidified by contacting a rolling copper roll, a rapidly-solidified thin strip in which a magnetic easy axis is arranged after the rapid solidifying is obtained.

The apparatus for rapidly solidifying liquid in the magnetic field according to an embodiment of the present invention may provide a rapidly-solidified thin strip by a single roll casting method considering a substantially fast rapidly-solidifying speed. However, the rapidly-solidified thin strip may also be fabricated by other methods, for example, a strip casting method and a twin-roll casting method.

A single roll casting method may be performed, for example, as follows.

Figure 1B:
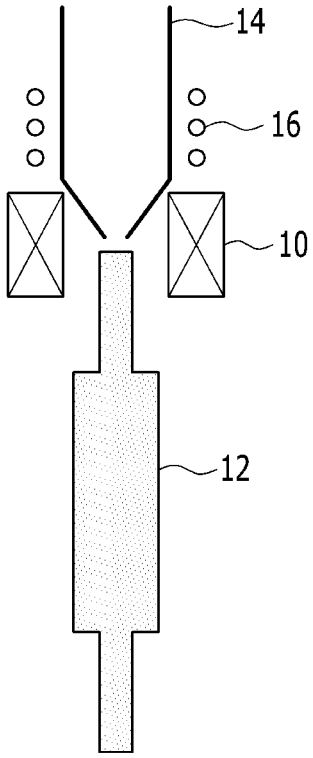
FIG. 1B is a schematic side view showing the embodiment of the apparatus according to the present invention.

First, a raw metal element including Samarium (Sm) or Cobalt (Co) or the like is dissolved to provide a mother alloy. Then, the mother alloy is melted, and the melted metal is sprayed onto a rotating copper roll in a predetermined speed using the apparatus for rapidly solidifying liquid in the magnetic field as shown in FIGS. 1A and 1B, which is used for a following Example 1, or the like.

In addition, an embodiment of the present invention may provide an anisotropic rare earth permanent magnet including a rapidly-solidified thin strip obtained by the apparatus for rapidly solidifying liquid in the magnetic field.

The anisotropic rare earth permanent magnet according to an embodiment of the present invention includes a rapidly-solidified thin strip obtained by rapidly solidifying an exchange spring magnet having an internal structure in which a hard magnetic phase and a soft magnetic phase are finely dispersed in the magnetic field by the apparatus for rapidly solidifying liquid in the magnetic field, where a magnetic easy axis of the hard magnetic phase in the rapidly-solidified thin strip is arranged in one direction.

The hard magnetic phase in the exchange spring magnet for the embodiment of the present invention may include at least one of $SmCo_5$, $Sm_2Co_{17}$ and $Nd_2Fe_{14}B$, for example, considering high crystalline magnetic anisotropy, which has a high coercive force. However, the embodiment of the present invention is not limited thereto, and the exchange spring magnet may include various other materials.

In addition, the soft magnetic phase of the exchange spring magnet may include at least one of α-Fe, FeCo and $Fe_3B$, for example, considering a high saturation magnetic flux density. However, the embodiment of the present invention is not limited thereto, and the exchange spring magnet may include various other materials.

In addition, an embodiment of the present invention may provide a bulk anisotropic rare earth permanent magnet obtained by temporarily molding the rapidly-solidified thin strip fabricated by the apparatus for rapidly solidifying liquid in the magnetic field by a magnetic field press, and sintering the same.

The anisotropic rare earth permanent magnet according to the embodiment of the present invention may include, for example, an anisotropic bulk permanent magnet obtained by heating the obtained rapidly-solidified thin strip at a predetermined temperature under a vacuum state to provide an anisotropic permanent magnetic powder, temporary molding a part of rapidly-solidified thin strip by a magnetic field press, and sintering the same at a predetermined temperature.

In order to provide an anisotropic rare earth permanent magnet having excellent magnetic characteristics, the following conditions are used.

1. The rapidly-solidified thin strip obtained by rapidly solidifying liquid may have a crystalline particle diameter less than or equal to about 100 nanometers (nm).

2. The magnetic easy axis of the hard magnetic phase may be arranged in one direction.

As a rapidly-solidified thin strip is fabricated by the apparatus for rapidly solidifying liquid in a magnetic field according to the embodiment of the present invention, the magnetic powder has a crystalline particle diameter less than or equal to about 100 nm, and the magnetic easy axis of the hard magnetic phase is arranged in one direction in the magnetic powder.

In addition, the obtained magnetic powder is temporarily molded by the magnetic field press and sintered to provide an anisotropic rare earth bulk permanent magnet.

According to the apparatus for rapidly solidifying liquid of the embodiment of the present invention, an anisotropic exchange spring magnet may be provided, and an anisotropic rare earth permanent magnet having a high coercive force and a high remaining magnetic flux density may be provided.

In addition, when the anisotropic rare earth permanent magnet obtained in the embodiment of the present invention is applied to the permanent magnetic motor, toque T is determined by the following formula.

$$T \propto P_n \Psi_a i_q$$

Herein, $P_n$ refers to a number of poles of a motor, $\Psi_a$ refers to a magnetic flux of a rotor magnet of a motor, and $i_q$ is a current of a stator winding.

The anisotropic rare earth permanent magnet of the embodiment of the present invention may remarkably improve the motor output since it has a higher magnetic flux as a rotor magnet of a motor than that of a conventional samarium magnet, for example.

The anisotropic rare earth permanent magnet according to the embodiment of the present invention is used in a motor or the like, and may also be applied to a rotator and a generator.

Hereinafter, examples of a method of manufacturing an anisotropic rare earth permanent magnet using the apparatus for rapidly solidifying liquid in a magnetic field according to an embodiment of the present invention is described together with comparative examples. Herein, as the representative example, a method of manufacturing a $SmCo_5$/α-Fe exchange spring magnet is described. However, the embodiment of the present invention is not limited to these examples.

The raw metal element may have a predetermined composition of Sm, Co, and at least two kinds of additional elements. The additional elements may include, for example, copper (Cu), iron (Fe), boron (B), niobium (Nb), zirconium (Zr), carbon (C), titanium (Ti), chromium (Cr) or a combination thereof. First, the raw metal is melted using an arc melting furnace or a high-frequency melting furnace under argon (Ar) atmosphere to provide a mother alloy.

FIGS. 1A and 1B are plan and side schematic views, respectively, showing an apparatus for rapidly solidifying liquid in a magnetic field. Referring to FIGS. 1A and 1B, in the single roll apparatus for rapidly solidifying liquid, a normal field magnetic circuit 10 using a permanent magnet is mounted between a quartz nozzle 14 and a copper roll 12 in a side view, that is, in a space where the melted metal is cooled by a copper roll. Herein, a direction of the magnetic field is parallel to a plane of the copper roll 12, the magnitude of the magnetic flux density is greater than or equal to about 1 T, and a space for applying magnetic field is about phi 10 millimeters (mmϕ) multiplied by 10 millimeters (mm). The obtained mother alloy is input into the quartz nozzle 14, and the mother alloy is melted by high frequency heating by a high frequency coil 16 under the Ar atmosphere. In an embodiment, the high frequency coil 16 may be disposed around the quartz nozzle 14 in a side view. The melted metal is sprayed on the copper roll 12 rolled at a predetermined speed by applying the Ar gas pressure to provide a rapidly-solidified thin strip in the magnetic field.

The rapidly solidifying without using the magnetic field is performed by removing the magnetic circuit, and the rapidly-solidified thin strip is fabricated in the above-mentioned order.

The obtained rapidly-solidified thin strip undergoes a heating treatment at a temperature of about 600 degrees Celsius (° C.) to about 800° C. under a vacuum state to provide an anisotropic permanent magnet powder. In addition, an anisotropic bulk permanent magnet is provided by temporarily molding a part of the rapidly-solidified thin strip by the magnetic field press and sintering the same at a temperature of about 600° C. to about 800° C.

Table 1 shows examples and comparative examples. Examples 1 to 5 are rapidly solidified by changing the copper roll speed corresponding to the rapidly-solidifying speed under a magnetic field of 1.0 T, and comparative Examples 1 to 2 are rapidly solidified by changing the copper roll speed without applying the magnetic field. In the examples and the comparative examples, copper roll speed is measured in meters per second (m/s), coercive force is measured in the kilo-oersted (kOe), and remaining magnetic flux density is measured in the electromagnetic unit per gram (emu/g).

According to Table 1, it is understood that Example 5 provides good characteristics of both the coercive force and the remaining magnetic flux density, and provides a higher magnetic characteristic than that of Comparative Example 2.

TABLE 1

| | Copper roll speed (m/s) | Coercive force (kOe) | Remaining magnetic flux density (emu/g) | Note |
|---|---|---|---|---|
| Example 1 | 10 | 9 | 70 | magnetic field 1.0 T |
| Example 2 | 20 | 10 | 75 | magnetic field 1.0 T |
| Example 3 | 30 | 15 | 80 | magnetic field 1.0 T |
| Example 4 | 40 | 20 | 90 | magnetic field 1.0 T |
| Example 5 | 50 | 25 | 100 | magnetic field 1.0 T |
| Comparative Example 1 | 30 | 15 | 30 | magnetic field 0.0 T |
| Comparative Example 2 | 50 | 20 | 50 | magnetic field 0.0 T |

According to the embodiment of the present invention, the apparatus for rapidly solidifying liquid in a magnetic field may provide an anisotropic exchange spring magnet and may provide an anisotropic rare earth permanent magnet having a high coercive force and a high remaining magnetic flux density; and the anisotropic rare earth element permanent magnet may have a higher magnetic flux as a rotor magnet of a motor than that of the conventional samarium magnet and may remarkably improve the motor output.

While the embodiment of disclosure has been described in connection with what is presently considered to be practical exemplary embodiments, it is to be understood that the embodiment of the present invention is not limited to the disclosed embodiments, but, on the contrary, is intended to cover various modifications and equivalent arrangements included within the spirit and scope of the appended claims.

What is claimed is:

1. An apparatus for solidifying liquid in a magnetic field comprising:

a quartz nozzle;

a means for solidifying a melted metal sprayed by the quartz nozzle; and a magnetic circuit adjacent to a region where the sprayed melted metal is solidified in the means for solidifying the melted metal.

2. The apparatus for solidifying liquid in the magnetic field of claim 1, wherein the magnetic circuit is provided adjacent to the region where the sprayed melted metal is solidified in the means for solidifying the melted metal, such that there is a space for applying a magnetic field of about phi 10 millimeters (mmΦ) multiplied by 10 millimeters.

3. The apparatus for solidifying liquid in the magnetic field of claim 1, wherein the means for solidifying the melted metal is a copper roll.

4. The apparatus for solidifying liquid in the magnetic field of claim 3, wherein the magnetic circuit applies the magnetic field to the region where the sprayed melted metal is solidified in the copper roll, and wherein a direction of the magnetic field is parallel to a plane of the copper roll.

5. The apparatus for solidifying liquid in the magnetic field of claim 1, wherein the magnetic circuit applies the magnetic field greater than or equal to about 1 tesla to the region where the sprayed melted metal is solidified in the means for solidifying the melted metal.

6. The apparatus for solidifying liquid in the magnetic field of claim 5, wherein the magnetic circuit applies the magnetic field less than or equal to about 8 tesla to the region where the sprayed melted metal is solidified in the means for solidifying the melted metal.

7. The apparatus for solidifying liquid in the magnetic field of claim 6, wherein the magnetic circuit applies the magnetic field less than or equal to about 2 tesla to the region where the sprayed melted metal is solidified in the means for solidifying the melted metal.

* * * * *